US005596309A

United States Patent [19]

Nabeshima et al.

[11] Patent Number: 5,596,309

[45] Date of Patent: Jan. 21, 1997

[54] REDUCED INDUCTANCE COAXIAL RESISTOR

[75] Inventors: Takashige Nabeshima, Tokyo; Katsuhisa Kato, Koshigaya; Toshiaki Hidaka, Tokyo, all of Japan

[73] Assignee: Sony/Tektronix Corporation, Tokyo, Japan

[21] Appl. No.: 279,319

[22] Filed: Jul. 22, 1994

[30] Foreign Application Priority Data

Jul. 30, 1993 [JP] Japan ..... 5-208267

[51] Int. Cl.[6] ..... H01C 3/02

[52] U.S. Cl. ..... 338/61; 338/214; 338/216

[58] Field of Search ..... 338/61–63, 214, 338/216

[56] References Cited

U.S. PATENT DOCUMENTS

| | | | |
|---|---|---|---|
| 2,387,829 | 10/1945 | Burnham et al. | 338/214 |
| 2,521,894 | 9/1950 | Brown | 338/61 |
| 2,529,914 | 11/1950 | Challenner | 338/214 |
| 3,729,409 | 4/1973 | Smart et al. | 338/214 |
| 3,757,088 | 9/1973 | Osborn | 338/214 |
| 4,510,468 | 4/1985 | Mayer | 338/214 |
| 4,631,392 | 12/1986 | O'Brien et al. | 338/214 |
| 4,739,935 | 4/1988 | Hastings et al. | 338/214 |
| 4,757,297 | 7/1988 | Frawley | 338/214 |
| 5,394,507 | 2/1995 | Okamoto | 338/214 |

*Primary Examiner*—Teresa J. Walberg
*Assistant Examiner*—Raphael Valencia
*Attorney, Agent, or Firm*—Smith-Hill and Bedell

[57] ABSTRACT

A coaxial type electrical resistor has a cylindrical conductor, a cylindrical insulator inserted into the opening of the conductor and a cylindrical resistor inserted into the opening of the insulator. Since the insulator is between the conductor and the resistor, a distance between the conductor and resistor may be small and magnetic flux leakage reduced. Thus the resistor has a small inductance and is appropriate as a high frequency large current resistor.

8 Claims, 4 Drawing Sheets

REDUCED INDUCTANCE COAXIAL RESISTOR

BACKGROUND OF THE INVENTION

The present invention relates generally to an electrical resistor, and more specifically to a coaxial resistor that has reduced inductance which is appropriate to be used when measuring a high frequency large current.

When a high frequency large current is measured, it is very important to reduce the inductance L of a current measurement instrument. If the current flows through an inductor having an inductance L, a voltage V across the inductor may be $-L(dI/dt)$ where the current value changes by dI during the period dt. Since the high frequency large current changes its value rapidly, the voltage across the inductor becomes large. Thus, the inductance is one of the main factors that cause measurement errors.

One method for measuring current is to insert a sensing resistor into the current path, detect a voltage across the resistor, and calculate the current value from the detected voltage and the resistor value. Resistors may be classified according to materials and shapes. According to a material classification, there are carbon, metal, metal oxide and mixture types of resistors. According to a shape classification, there are wire-wound and film types of resistors. Since wire-wound type resistors are similar to coils in configuration, such resistors have large inductance values. Cylindrical type carbon or metal film resistors are formed by making cylindrical grooves in the resistance material. Therefore these type resistors are similar to coils and also have large inductance values. A non-groove resistor is proposed for high frequency applications in order to reduce the inductance value of the resistor. However the distance between the input and output terminals of the resistor is finite to obtain the resistance value so that inductance still exists within the resistor.

It has been proposed to reduce the inductance of a resistor by having a backward current flow in the opposite direction of a forward current. The magnetic flux based on the forward current is cancelled in theory by the one based on the backward current in order to reduce the inductance. To accomplish this proposal a so-called "non-inductive" resistor is wound with balanced or bifilar windings. This technology may be applied to a resistor assembly as shown in FIG. 1.

In FIG. 1 a series connection of a conductive path 14A and a resistive path 12 are provided on an upper surface of an insulating substrate 10. A conductive plate 14B is provided on a bottom surface of the insulating substrate 10 and the opposite end of the resistive path 12 is connected to the conductive plate 14B along the edge of the insulating substrate 10. Thus a strip line type series circuit comprises the conductors 14A, 14B and the resistor 12. The ends of the conductors 14A and 14B are used as input and output terminals B and A.

Since a current is applied to the input terminal B and is derived from the output terminal A, the current flowing in one direction on the upper path is opposite to that flowing on the lower path. Thus the magnetic flux is canceled to reduce the inductance of the resistor assembly. The cancellation effect depends on the thickness of the insulating substrate 10, i.e., a smaller inductance is obtained from a thinner substrate because there is a smaller space for magnetic flux leakage.

Even if the space between the resistive path 12 and the conductive plate 14B is reduced considerably in the configuration of the resistor assembly shown in FIG. 1, the amount of inductance reduction is limited because of an edge effect. According to this edge effect electric flux lines are bent outward at positions adjacent to the edges of the parallel current paths. Thus the magnetic flux extends outward from the substrate 10 and cannot be cancelled completely.

This edge effect may be reduced by using a cylindrical resistor and a pole type conductor where one end of the cylindrical resistor is open but the other end is closed. The conductor is inserted from the open end of the cylindrical resistor and one end of the conductor is connected to the closed end of the cylindrical resistor. Such an electrical resistor is disclosed in U.S. Pat. No. 4,322,710 issued on Mar. 30, 1982. FIG. 2 shows a coaxial type electrical resistor which is conceptually similar to but slightly different from the one disclosed in U.S. Pat. No. 4,322,710.

In FIG. 2 an inner cylinder 20 has edge conductor portions 20A and 20B and a resistor portion (layer) 26 inserted between the edge portions 20A and 20B. One end of the conductor portion 20A is closed. An outer cylinder 22 is a conductor and encloses the inner cylinder 20. The edges of the conductive cylinders 20B and 22 are coupled to each other. There is a cylindrical space (air gap) 24 between the inner cylinder 20 and the outer cylinder 22. The cylindrical resistor 26 may be manufactured by hollowing out a column shaped resistive material.

A pole-shaped center conductor 28 is inserted into an interior space of the inner cylinder 20 and one end thereof is coupled to the conductor portion 20A. A short cylindrical conductor 27 is provided at the other ends of the cylinders 20B and 22 and the center conductor 28 passes through an opening of the cylindrical conductor 27.

A current to be measured is applied to an input terminal B of the inner cylinder 20 and extracted from an output terminal A of the outer cylinder 22. Since the current flows through the inner cylinder 20 and the resistor 26 in the opposite direction to the current in the outer cylindrical conductor 22, the magnetic flux is substantially cancelled to reduce the inductance. The edge effect is improved by the cylindrical configuration. A voltage across the cylindrical resistor 26 is detected through terminals C and D of the conductors 27 and 28. The current value may be calculated from the detected voltage and the value of the resistor 26.

The electrical resistor shown in FIG. 2 may reduce its inductance substantially. However the space 24 between the inner resistor 26 and the outer conductor 22 provides a region where magnetic flux may occur. As a result inductance still exists in the resistor. When such a resistor is used to detect high frequency large currents, even a small inductance, such as 1 nano-henry, of the resistor causes a large measurement error. For example when a current of 100 ampere flows through a resistor of 10 milli-ohm, the voltage across the resistor may be 1 volt. If the inductance of the resistor is 1 nano-henry and the current changes from zero amperes to 100 amperes over a period of 100 nano-seconds, the inductance produces 1 volt in accordance with $V=-L(dI/dt)$. The voltage based on this inductance is the same as the voltage across the resistor. Thus it is very important to reduce the inductance of the resistor to be as close to zero as possible.

In order to reduce the inductance it is necessary to have the space distance between the inner resistor 26 and the outer cylindrical conductor 22 be small. However the space distance is limited by the manufacturing methods and by the insulation characteristics between the cylinders 20 and 22. If the resistor layer 26 is thick, the high frequency current is apt to flow through the surface of the resistor layer 26 because of conductor skin effect. In other words the value of the resistor layer depends on the current frequency. It is very important that the resistance value be constant when measuring high frequency current with a coaxial type resistor. In order to resolve this problem, it is necessary to make the resistor layer thin. Also the resistor 26 may contract and be unstable because of Lorentz forces that occur since the surface of the cylindrical resistor 26 is not supported.

What is desired is a reduced inductance coaxial type electrical resistor that is suitable for measuring a high frequency large current. Moreover it is desired to provide a strongly-manufactured coaxial type resistor, the resistance of which is stable regardless of the current frequency.

SUMMARY OF THE INVENTION

According to a first aspect of the present invention, an electrical resistor has an outer cylindrical conductor, a cylindrical insulator and a cylindrical resistor. The cylindrical insulator is inserted into the opening of the outer cylindrical conductor and the outer surface of the cylindrical insulator touches the inner surface of the outer cylindrical conductor. The resistor is provided on the inner surface of the cylindrical insulator. One end of the resistor is coupled to one end of the outer cylindrical conductor and the other ends of the outer cylindrical conductor and the resistor are input and output terminals for the electrical resistor. The cylindrical insulator may be a ceramic material.

According to a second aspect of the present invention, a metal oxide layer or a high polymer molecule resin layer is formed on the inner surface of the outer cylindrical conductor. The resistor is formed on the inner surface of the oxide layer or the high polymer molecule resin.

According to a third aspect of the present invention, an insulating layer is provided on the inner surface of the outer cylindrical conductor. A resistor layer is formed on an outer surface of a cylindrical insulating supporter member that is inserted into the opening of the outer cylindrical conductor having the insulating layer. There is no space gap between the outer cylindrical conductor and the supporting member.

Since the insulator is between the outer conductor and the resistor, a distance between the conductor and resistor may be minimum and magnetic flux leakage is substantially reduced. Thus the electrical resistor according to the present invention has a very small inductance value.

The subject matter of the present invention is particularly pointed out and distinctly claimed in the concluding portion of this specification. However, both the organization and method of operation, together with further advantages and objects thereof, may best be understood by reference to the following detailed description when read in connection with the accompanying drawing figures.

DESCRIPTION OF THE PREFERRED EMBODIMENT

Figure 2:
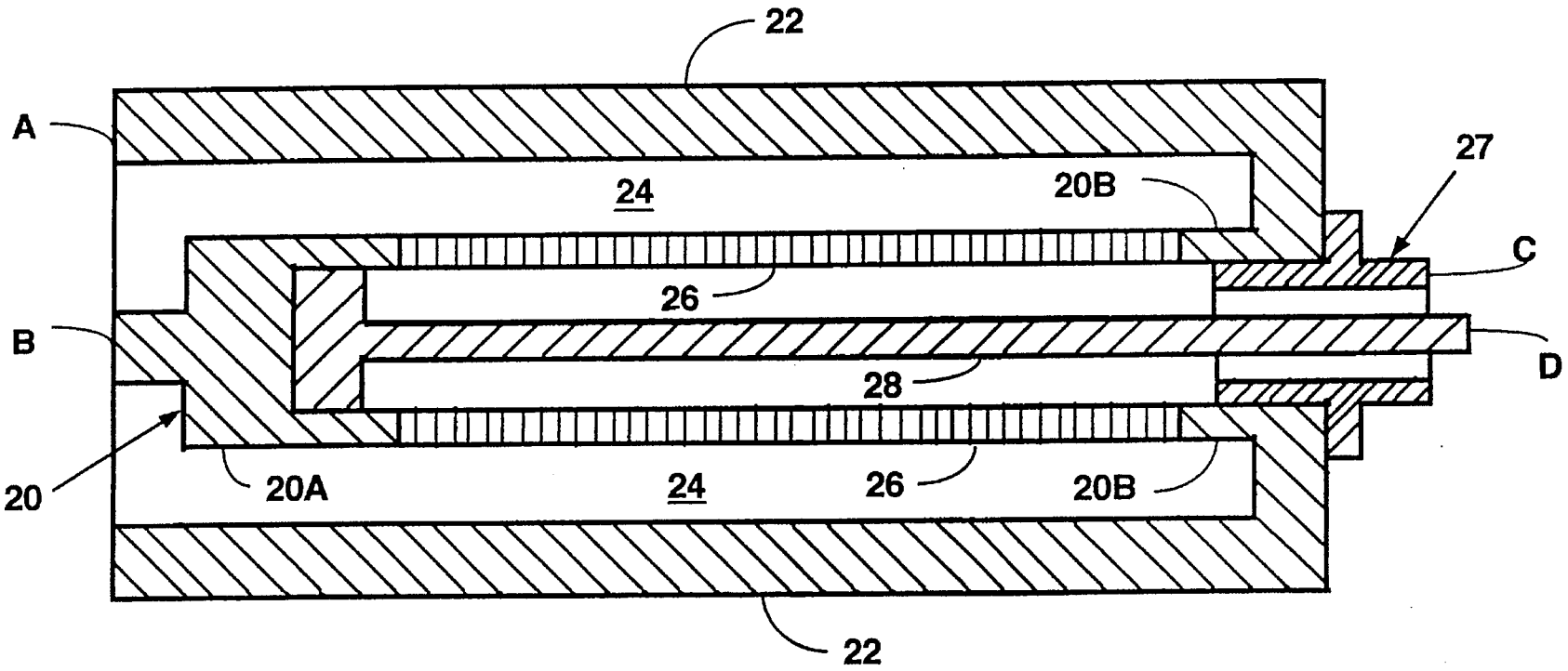
FIG.2 (PRIOR ART)
FIG. 2 is a cross-sectional view of another conventional resistor.
Figure 3:
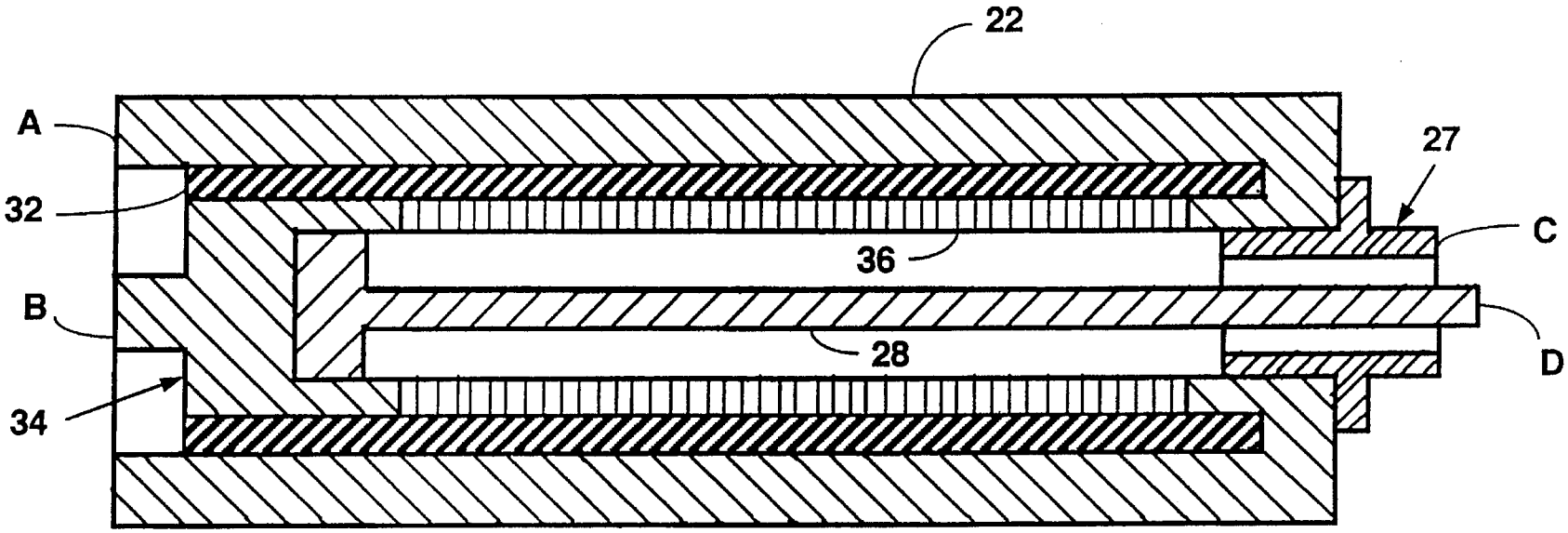
FIG. 3 is a cross-sectional view of one embodiment of an electrical resistor according to the present invention.

Referring to FIG. 3 there is shown a cross-sectional view of one preferred embodiment according to the present invention where the electrical resistor is cut along a longitudinal center axis of a cylindrical configuration. This embodiment is similar to the conventional resistor shown in FIG. 2, so that the same reference numbers are used to designate like parts and only the differences will be discussed.

A cylindrical insulating layer or an insulator 32 is inserted between the outer cylindrical conductor 22 and a center conductor 34 and cylindrical resistor layer 36. For example, the conductors 22 and 34 may be aluminum and the insulating layer 32 may be ceramic. The thickness of the insulating layer may be several tens through hundreds of micrometers. Such an insulating layer may be formed by providing a metal oxide film on the inner surface of the cylindrical conductor 22 or the outer surface of the center conductor 34. In the latter case, the center conductor 34 should be a cylindrical conductor extending to cover substantially all of the outer conductor 22. If a metal oxide film is used as the insulating layer 32, the thickness of the layer 32 may be even further reduced. When the thickness of the insulating layer 32 is small, the space for magnetic flux leakage is small and inductance is further reduced. In any event the distance between the outer conductor 22 and the resistor layer 36 is smaller than the prior art shown in FIG. 2 because of the insulating layer 32.

Similar to the prior art shown in FIG. 2, one end (left end as shown in the drawing figure) of the resistor layer 36 is coupled to the inner conductor 34 and the other end (right end) thereof is coupled to the outer conductor 22. The left ends of the conductors 34 and 22 are the input and output terminals B and A respectively. The conductors 27 and 28 (terminals C and D) are provided to derive the voltage across the resistor layer 36. Since the insulating spacer 32 is provided between the outer conductor 22 and the resistor layer 36, heat produced by the resistor 36 is conducted through the insulating layer 32 to the outer conductor 22 which operates as a heat sink. The heat conductivity of the insulating layer 32 is better than that of an air gap.

In the case where a cylindrical ceramic is used as the insulating layer 32, the resistor layer 36 may be formed on the inner surface of the cylindrical ceramic and then both of them may be assembled with the cylindrical conductor 22 and the center conductor 34. The cylindrical ceramic is used as proof against the sintering temperature of the resistor layer 36. When forming the resistor layer 36, the thickness thereof should be made as thin as possible to reduce the skin effect. To produce a mixture film resistor as the resistor layer 36, a combination of carbon and resin or of metal and glass is sintered. Such a resistor is called a solid resistor or a thick film resistor. This method is used to form the resistor layer 36 on the inner surface of the cylindrical ceramic and the thickness of the resistor layer 36 may be several tens of micrometers. The film resistor may be manufactured by another method.

Another embodiment of the present invention is similar to the embodiment shown in FIG. 3, however, the insulating layer 32 is made of a metal oxide film. After the insulating layer 32 of the metal oxide film is formed on the inner surface of the cylindrical conductor 22, the resistor material is applied on the insulating layer 32 and is heated for the sintering to produce the cylindrical resistor layer 36. This method makes both the insulating layer 32 and the resistor layer 36 very thin so that the inductance is greatly reduced and the frequency response is improved. If the cylindrical conductor is made of aluminum, a stable oxide film (alumina) may be formed easily.

According to an additional embodiment of this invention, the insulating layer 32 may be made of macromolecule resin instead of the metal oxide film where the macromolecule resin has good high-temperature and frequency characteristics (keeping the insulation properties at high frequencies). For example a fluororesin such as TELFON (trademark) or a polyimide may be used as the insulating layer 32. The macromolecule resin 32 is formed on the inner surface of the cylindrical conductor 22 by a well-known method, such as evaporation, spattering or the like.

Figure 4:
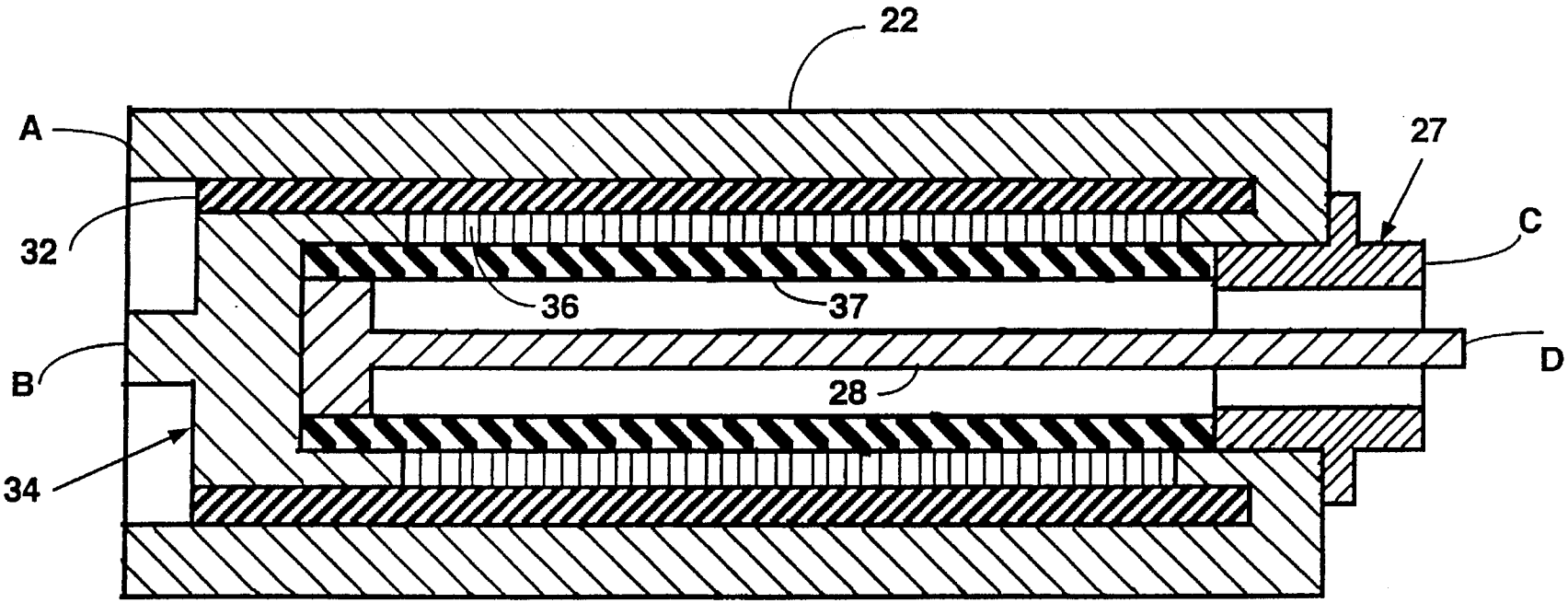
FIG. 4 is a cross-sectional view of another embodiment of an electrical resistor according to the present invention.

FIG. 4 shows a further additional embodiment of the present invention where a carbon or metal type mixture film resistor layer 36 is formed by sintering on an outer surface of an insulating cylindrical support 37. It is easy to form the sintered resister layer 36 on the outer surface of the cylindrical member 37. However the insulating cylindrical supporter 37 should be proof against the sintering temperature of the resistor layer. A cylindrical ceramic is appropriate as the insulating cylindrical support 37, and operates as a heat sink for radiating the heat produced by the cylindrical resistor layer 36. Of course the heat of the resistor layer 36 may be conducted through the insulating layer 32 to the outer conductor 22 as well.

In the embodiment of FIG. 4 the insulating layer 32 may be a cylindrical ceramic material having a thin thickness, an oxide film or a high polymer molecule resin. Since it is not necessary to sinter the resistor layer 36 on the insulating layer 32, the insulating layer 32 may be made of an insulating material, such as polyester, which has a thin thickness but is not be proof against the sintering temperature of the resistor layer 36. This embodiment may be manufactured inexpensively.

In any of the embodiments of the present invention the insulating layer 32 should be made of a heatproof material having good heat conductivity because the resistor layer 36 generates heat.

As described above the embodiments shown in FIGS. 3 and 4 may be used to detect the current value by flowing the current through the resistor 36 and detecting the voltage across the resistor. Terminals A and B are used to apply and extract the current to and from the resistor and terminals C and D are used to derive the voltage across the resistor. If terminals C and D are modified to be either a BNC or an M-type connector, the resistor may be connected directly to a voltage measurement instrument easily.

Figure 5:
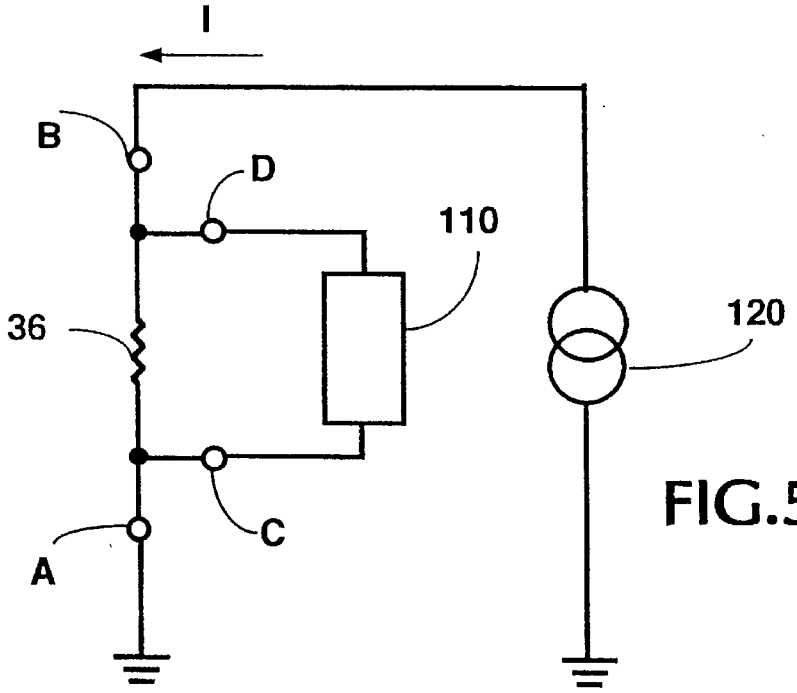
FIG. 5 is a circuit diagram explaining a Kelvin sensing circuit using the electrical resistor according to the present invention.
Figure 1:
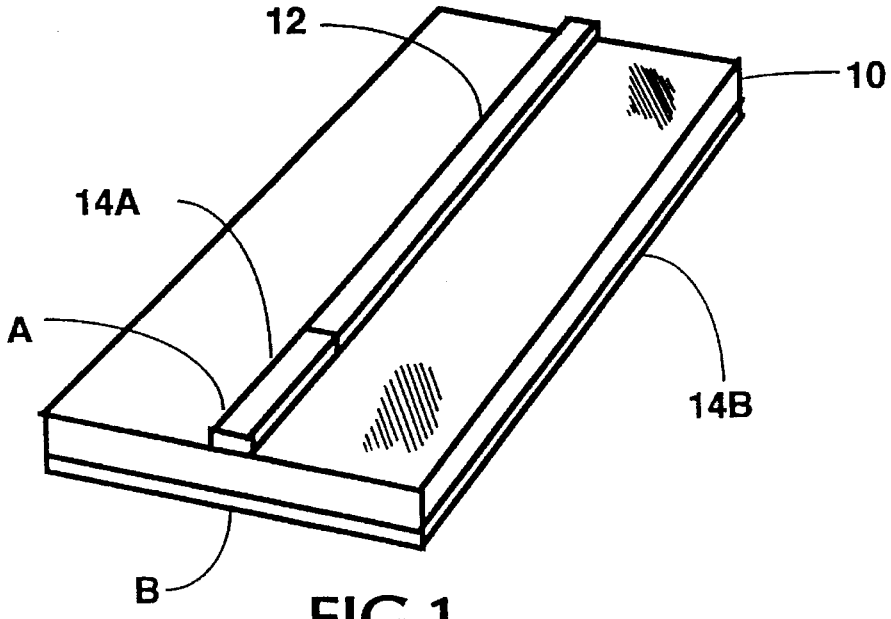
FIG.1 (PRIOR ART)
FIG. 1 is a perspective view of a conventional resistor.

FIG. 5 shows a simplified block diagram of a current measurement system. In this drawing, the terminals A, B, C and D correspond to the terminals A, B, C and D of the electrical resistor shown in FIG. 3 and 4. The current I from a current source 120 flows through the terminal B, the resistor 36 and terminal A and then returns to the current source 120 through ground. The voltage measurement instrument 110 measures the voltage between terminals C and D, i.e., the voltage across the resistor 36. Contact resistances may exist at terminals A, B, C and D respectively and the voltage drop may be produced by the resistance of each contact. However the voltage across terminals A and B does not affect the voltage across the resistor 36. Since the input impedance of the voltage measurement instrument 110 is very large, the current cannot flow substantially through the instrument 110 and no voltage drop may occur at the terminals C and D due to contact resistance. Thus the measurement result is accurate.

As described above the present invention reduces the distance between the cylindrical outer conductor and the cylindrical resistor by providing an insulator therebetween and the thickness of the insulating layer may be very thin, so that magnetic flux leakage is reduced substantially. Thus the inductance of the resistor may be reduced, for example, to 50 pico-henry. Since the resistor layer may be thin, the frequency response of the electrical resistor is improved. The outer or both surfaces of the resistor layer touch the cylindrical insulator, thereby making the electrical resistor solid.

While the preferred embodiments of this invention have been shown and discussed herein, it is apparent that many changes and modifications may be made without departing from this invention in its broader aspect. Therefore, the scope of the present invention should be determined by the following claims.

What is claimed is:

1. An electrical resistor comprising:

a first cylindrical conductor having an inner surface and a central axis and having a first end spaced apart from a second end thereof in a first direction along said central axis;

a cylindrical insulator provided on the inner surface of said first cylindrical conductor in coaxial relationship therewith, said cylindrical insulator having an inner surface and having a radial thickness in the range from several tens of micrometers to hundreds of micrometers;

a cylindrical resistor provided on the inner surface of said cylindrical insulator in coaxial relationship therewith and having a first end spaced apart from a second thereof in said first direction, said first end of said cylindrical resistor being coupled to said first end of said first cylindrical conductor so that when said second end of said first cylindrical conductor and said second end of said cylindrical resistor are connected to a current source, an electrical current flows through said first cylindrical conductor and said cylindrical resistor in opposite respective directions;

a second cylindrical conductor coupled to said first end of said first cylindrical conductor, said second cylindrical conductor defining an opening; and a center conductor inserted into an opening of said cylindrical resistor and having a first end spaced apart from a second end thereof in said first direction, said second end of said center conductor being coupled to said second end of said cylindrical resistor and said second end of said center conductor extending through the opening of said second cylindrical conductor so that a voltage across said cylindrical resistor is derived from said second end of said center conductor and said second cylindrical conductor in response to electrical current flowing through said cylindrical resistor.

2. An electrical resistor according to claim 1 wherein said cylindrical insulator comprises a ceramic material.

3. An electrical resistor according to claim 1 wherein the cylindrical conductor comprises aluminum and the cylindrical insulator comprises a film of alumina.

4. An electrical resistor according to claim 1 wherein the cylindrical conductor comprises a metal and the cylindrical insulator comprises an oxide of the same metal as the cylindrical conductor.

5. An electrical resistor according to claim 4 wherein the metal oxide layer is formed on the inner surface of the cylindrical conductor by oxidizing the cylindrical conductor.

6. An electrical resistor, comprising:

a first cylindrical conductor having an inner surface and a central axis and having a first end spaced apart from a second end thereof in a first direction along said central axis;

a metal oxide layer provided on the inner surface of said first cylindrical conductor in coaxial relationship therewith, said metal oxide layer having an inner surface;

a cylindrical resistor provided on the inner surface of said metal oxide layer in coaxial relationship therewith and having a first end spaced apart from a second thereof in said first direction, said first end of said cylindrical resistor being coupled to said first end of said first cylindrical conductor so that when said second end of said first cylindrical conductor and said second end of said cylindrical resistor are connected to a current source, an electrical current flows through said first cylindrical conductor and said cylindrical resistor;

a second cylindrical conductor coupled to said first end of said first cylindrical conductor, said second cylindrical conductor defining an opening; and a center conductor inserted into an opening of said cylindrical resistor and having a first end spaced apart from a second end thereof in said first direction, said second end of said center conductor being coupled to said second end of said cylindrical resistor and said second end of said center conductor extending through the opening of said second cylindrical conductor so that a voltage across said cylindrical resistor is derived from said second end of said center conductor and said second cylindrical conductor in response to electrical current flowing through said cylindrical resistor.

7. An electrical resistor according to claim 6 wherein the cylindrical conductor comprises a metal and the metal oxide layer comprises an oxide of the same metal as the cylindrical conductor.

8. An electrical resistor comprising:

a first cylindrical conductor having an inner surface and a central axis and having a first end spaced apart from a second end thereof in a first direction along said central axis;

a high polymer molecule resin layer provided on the inner surface of said first cylindrical conductor in coaxial relationship therewith, said high polymer molecule resin layer having an inner surface;

a cylindrical resistor provided on the inner surface of said high polymer molecule resin layer in coaxial relationship therewith and having a first end spaced apart from a second thereof in said first direction, said first end of said cylindrical resistor being coupled to said first end of said cylindrical conductor so that when said second end of said first cylindrical conductor and said second end of said cylindrical resistor are connected to a current source, an electrical current flows through said cylindrical conductor and said cylindrical resistor;

a second cylindrical conductor coupled to said first end of said first cylindrical conductor, said second cylindrical conductor defining an opening; and a center conductor inserted into an opening of said cylindrical resistor and having a first end spaced apart from a second end thereof in said first direction, said second end of said center conductor being coupled to said second end of said cylindrical resistor and said second end of said center conductor extending through the opening of said second cylindrical conductor so that a voltage across said cylindrical resistor is derived from said second end of said center conductor and said second cylindrical conductor in response to electrical current flowing through said cylindrical resistor.

* * * * *